United States Patent [19]

Toth

[11] Patent Number: 4,780,056

[45] Date of Patent: Oct. 25, 1988

[54] TURBO-COMPRESSOR HAVING AIR COOLED BEARING

[75] Inventor: Dennis W. Toth, Pontiac, Mich.

[73] Assignee: Can-Am Engineered Products, Inc., Livonia, Mich.

[21] Appl. No.: 67,305

[22] Filed: Jun. 29, 1987

[51] Int. Cl.[4] ..... F04D 29/04; F04B 35/00

[52] U.S. Cl. ..... 415/180; 417/359; 417/362

[58] Field of Search ..... 415/116, 180, 122 R, 415/117; 417/234, 359, 362

[56] References Cited

U.S. PATENT DOCUMENTS

| | | | |
|---|---|---|---|
| 2,601,030 | 6/1952 | Klein et al. | 417/362 X |
| 2,733,001 | 1/1956 | McDonald | 415/116 X |
| 2,826,354 | 3/1958 | Field | 417/234 X |
| 3,069,071 | 12/1962 | Carlson | 415/180 X |
| 3,101,890 | 8/1963 | Carlson | 417/362 X |
| 3,320,895 | 5/1967 | Peterson et al. | 417/362 X |
| 4,341,506 | 7/1982 | Klein | 417/362 |

FOREIGN PATENT DOCUMENTS

| | | | |
|---|---|---|---|
| 712470 | 6/1965 | Canada | 417/362 |
| 116986 | 6/1946 | Sweden | 415/180 |

*Primary Examiner*—Abraham Hershkovitz
*Assistant Examiner*—Joseph M. Pitko
*Attorney, Agent, or Firm*—Arnold S. Weintraub

[57] ABSTRACT

A turbo-compressor air supply system for supplying air at relatively low pressure and high volume to a paint spray system or the like. The air supply system comprises a drive motor including a casing, a drive shaft projecting from the casing and air intake means in fluid communication with the casing. A turbo-compressor is provided which includes a housing, a drive shaft having first and second projecting ends, a bearing housing projecting from the compressor housing and disposed concentrically around and spaced from a projecting end of the drive shaft and a bearing disposed concentrically around the projecting end. A drive train couples the compressor drive shaft with the other projecting end of the drive motor drive shaft to enable the motor to drive the turbo-compressor. Means are provided for placing the bearing housing in fluid communication with a drive motor casing and associated air intake means to provide cooling for the bearing.

11 Claims, 3 Drawing Sheets

TURBO-COMPRESSOR HAVING AIR COOLED BEARING

BACKGROUND OF THE INVENTION

1. Field of the Invention:

The present invention relates to the field of turbo-compressor air supply systems and, more particularly, to an apparatus for cooling a bearing mounted around a shaft of the turbo-compressor.

2. Description of the Prior Art:

There are presently available industrial spray painting systems in which a turbo-compressor and its associated drive motor are mounted upon a cart so that the unit may be moved about within the plant to the article to be painted.

In units of this type, the motor and turbo-compressor typically are mounted side by side upon a horizontal plate which constitutes the top of the cart with the motor shaft and turbine shaft extending vertically downwardly through their housings and the mounting plate to be coupled to each other by a drive belt located below the mounting plate. Typically, a box-like chamber is provided at the underside of the mounting plate to enclose the shafts and drive belt which are driven at relatively high speed.

In the usual case, the turbo-compressor also includes bearings which are mounted around the turbine shaft at upper and lower locations thereon. Due to the high speed of rotation of the turbine shaft, a great deal of heat is generated. Conventionally, both the upper and lower turbine shaft bearings are located inside the housing which covers the turbo-compressor. Because of this confinement inside the turbo-compressor housing, the heat in the immediate environment of the turbine shaft bearings does not become dissipated and can build up to high levels. For example, it has been found that the operating temperature in the vicinity of the upper turbine shaft bearing can reach 207° F. or higher. Temperatures of this level often exceed the performance specifications of the bearing and, hence, contribute to premature bearing failure.

Obviously, it would be highly desirable if a turbo-compressor of the type described were designed with provisions made for a cooler operating environment for the upper turbine shaft bearing. The present invention is especially directed to an apparatus for cooling the shaft bearing adapted for use in the system described above.

SUMMARY OF THE INVENTION

In accordance with the present invention, the turbine shaft is lengthened so that the upper shaft bearing is disposed outside the turbo-compressor housing. To that end, a bearing housing is mounted around the top of the extended turbine shaft. The bearing is disposed between the shaft and the housing, preferably within an air space between at least part of the bearing and at least part of the bearing housing. Furthermore, means are provided for placing the bearing housing in fluid communication with means for supplying cooling fluid. In the preferred embodiment, the means for supplying cooling fluid comprises the casing disposed around the drive motor which has, as is conventional, a plurality of air inlets formed at the top thereof. The air inlets in the drive motor casing allow ambient air to flow into the drive motor casing thereby helping cool the drive motor. By placing these inlets in fluid communication with the bearing housing of the turbo-compressor, a portion of the air taken in by the air inlets. can be diverted into and through the bearing housing to provide cooling for the environment surrounding the bearing. Alternatively, means for supplying cooling air comprises an auxiliary air supply system such as an air compressor, a fan, etc.

In one preferred embodiment, the bearing housing further comprises air inlet means and air outlet means. Furthermore, an air outlet is provided in the drive motor casing adjacent the air inlets therein. A hollow tube provides fluid communication between the air outlet in the drive motor casing and the air inlet in the bearing housing. When the drive motor and turbo-compressor are in operation, a portion of the ambient air entering the air inlets in the drive motor casing will be diverted out of the air outlet therein, thence through the hollow tube, thence through the air inlet in the bearing housing, and thence through the air outlet therein. This diverted stream of air will provide cooling for the bearing contained in the bearing housing.

The means of fluid communication may further comprise a means of adjusting a length thereof to provide for varying pulley sizes and drive belt lengths. Preferably, the means of adjusting the length of the means of fluid communication, typically a hollow tube, comprises an adjustable slide disposed over an end of the hollow tube. The adjustable slide includes means of connection to either the air inlet in the bearing housing or the air outlet in the drive motor casing.

Other objects and features of the invention will become apparent by reference to the following specification and to the drawings.

IN THE DRAWINGS

DETAILED DESCRIPTION OF THE PREFERRED EMBODIMENTS

Figure 1:
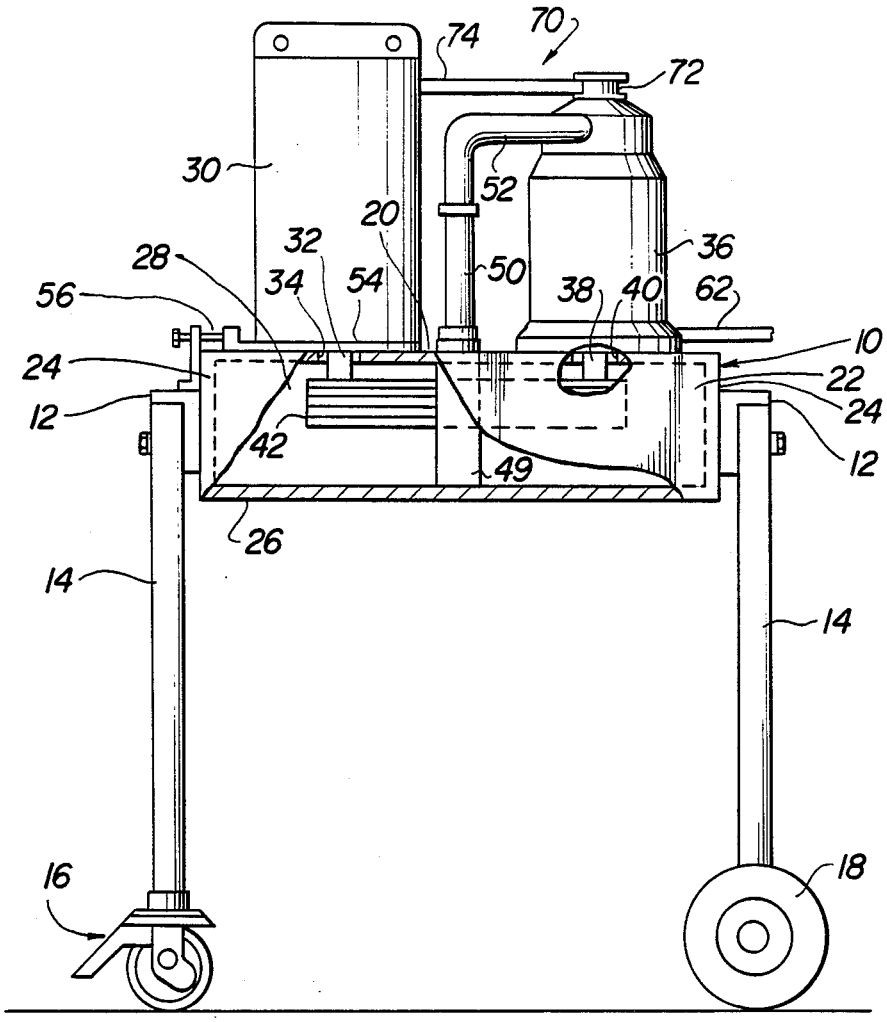
FIG. 1 is a side elevational view, with certain parts broken away or shown in section, of a turbo-compressor air supply system embodying the present invention.

Throughout the following description and drawing, identical reference numbers are used to refer to the same components shown in multiple figures of the drawing.

Figure 2:
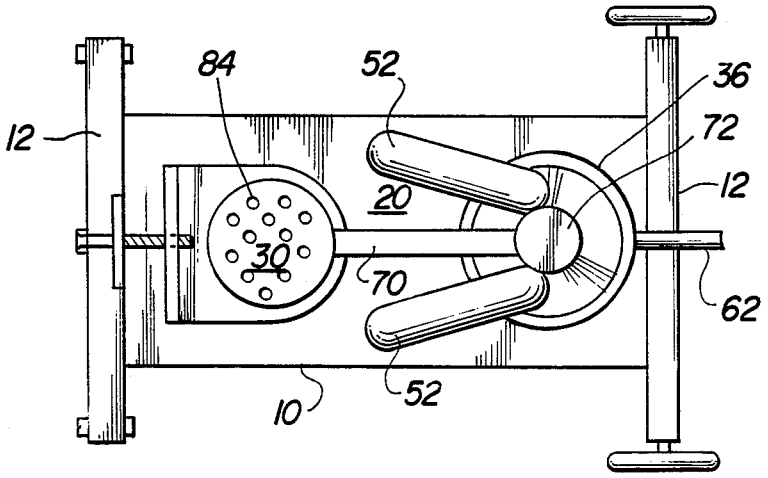
FIG. 2 is a top plan view of the apparatus of FIG. 1.

Referring first to FIGS. 1 and 2 a portable air supply system embodying the present invention includes a hollow box-like housing designated generally 10 having cross frame members 12 fixedly secured to its opposite ends and projecting outwardly beyond the opposite sides of the box as best seen in FIG. 2. From each end of each cross frame member 12, vertical legs project downwardly, one set of legs 14 having caster 16 mounted wheels mounted at the lower end, while the other set of legs 14 rotatably carries a somewhat larger, non-steerable set of wheels 18.

Housing 10 is a simple rectangular box formed with a top wall 20, opposed sidewalls 22, end walls 24 and a bottom wall 26. Bottom wall 26 is removable, being held to the side and end walls 22, 24 by bolts, not shown, to provide access to the chamber 28 within the housing.

An electric drive motor 30 is mounted upon the top wall of the housing with its drive shaft 32 disposed vertically and projecting downwardly through an opening 34 in top wall 20. A multi-stage turbo-compressor 36 is also fixedly mounted upon top wall 20 with its drive shaft 38 projecting downwardly through an opening 40 in top wall 20. Rotation of the shaft of drive motor 30 is transmitted to the shaft 38 of turbo-compressor 36 by a belt and pulley drive designated generally 42 located within chamber 28. Bottom wall 26 is formed with two reasonably large openings (not shown).

A pair of open ended vertically disposed tubular pipes 49 project vertically through housing 10 and are fixedly secured within tightly fitting openings, not shown, in top wall 20 and bottom wall 26 of the housing. A flexible wall tube 50 is clamped to the upper end of each pipe 49 to connect the pipe to extensions 52 of the air inlets to compressor 36.

Drive motor 30 is mounted upon a plate 54 which is slidable relative to top wall 20 of the housing. An adjustment bolt 56 is operable to position the motor longitudinally of the housing to thereby regulate the tension of the drive belt of the belt and pulley drive 42. When the belt tension is adjusted, plate 54 is clamped in position to top wall 20 by bolts not shown.

Figure 3:
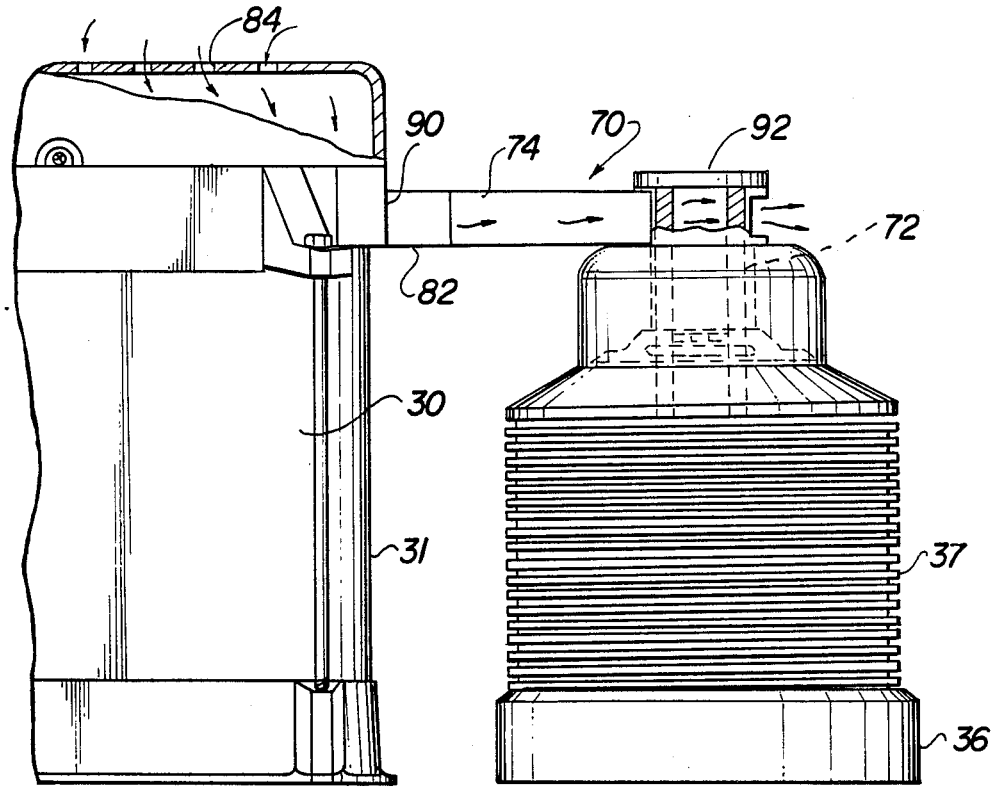
FIG. 3 is a detailed view, with certain parts broken away or shown in section, of upper portions of the turbo-compressor and motor of FIG. 1.
Figure 4:
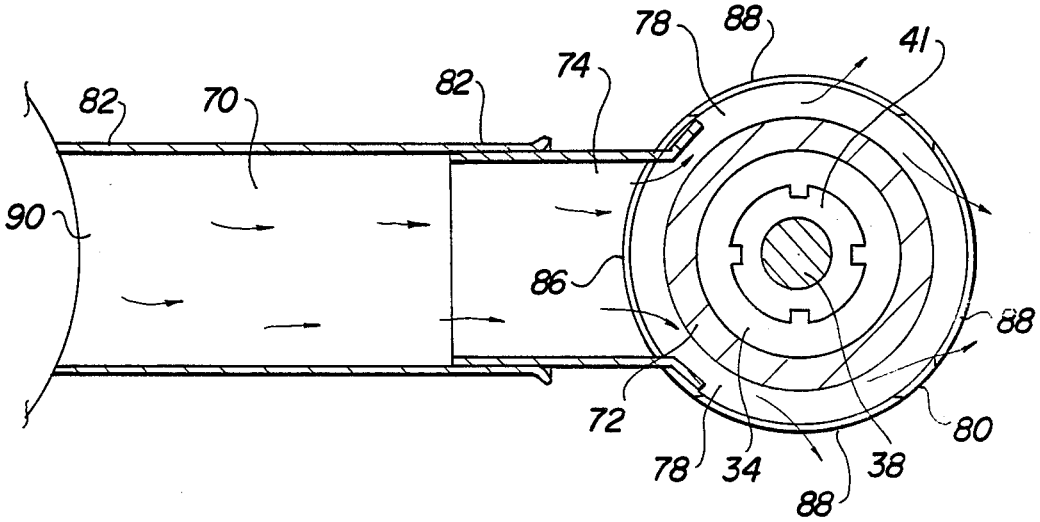
FIG. 4 is a cross sectional view along lines 4—4 of FIG. 3.

Referring now particularly to FIG. 3, a detailed view of the upper end of compressor 36, there is provided a bearing housing 72 which projects from the compressor housing 37. Compressor housing 37 is formed with a sleeve 80 which encases bearing housing 72. As can be seen by referring to FIGS. 4 and 5, the bearing housing 72 is disposed concentrically around and spaced from an upper projecting portion of the drive shaft 38. The bearing 34 is mounted onto shaft 38 by means of a nut 41. An air space 78 is formed between at least part of the inside of sleeve 80 and the inside of bearing housing 72. Air space 78 is further defined by cap 92 and top plate 94 which, respectively, seal off the top and bottom of air space 78. A shaft seal 96 is disposed between the top of shaft 38 and cap 92. Sleeve 80 further comprises an air inlet 86 and air outlets 88 as can be seen in FIG. 4.

As is conventional, a plurality of air inlets 84 are formed in the top of the casing 31 which encloses drive motor 30. As can be seen from the arrows, which indicate air flow direction, ambient air enters first the plurality of air inlets 84 and the motor housing 31. An air outlet 90 adjacent the top of motor casing 31 is provided. A means of fluid communication in the form of a hollow tube 74 connects air outlet 90 and air inlets 86 formed in sleeve 80. By means of hollow tube 74, a portion of a stream of air introduced into motor casing 31 by means of the plurality of inlets 84 is diverted around bearing housing 72. It flows through air space 78 therein and then exits by means of air outlet 88. This flow of air is indicated by the arrows in FIGS. 3 and 4. By means of the portion of air which is diverted around the bearing housing 72, the environment in which the bearing 34 operates is made cooler.

The operating temperature of the upper shaft bearing 34 of the turbo-compressor of the instant invention under actual operating conditions has been found to be approximately 180° F. This represents a temperature drop of approximately 37° F. attributable to the design of the air cooled turbo-compressor of the instant invention. The temperature drop is largely due to two factors. First, by extending turbine shaft 38 so that it projects out of the upper end of compressor housing 36, the bearing is no longer subjected to much of the heat generated by the operation of the turbo-compressor. Secondly by diverting some of the air flowing through the motor casing 31 around the bearing housing 72, a further cooling effect is achieved.

Figure 5:
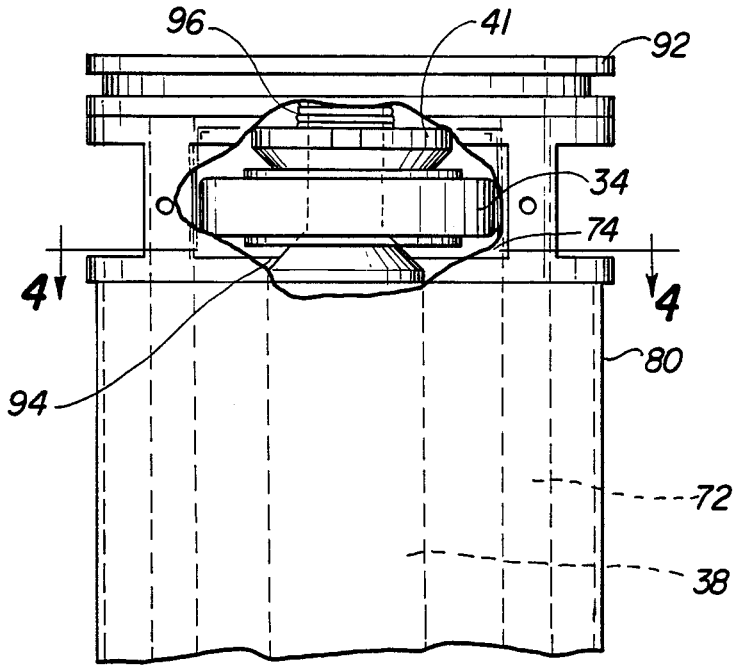
FIG. 5 is a detailed view, with certain parts broken away or shown in section, of the upper portion of the turbo-compressor of FIG. 1.
Figure 6:
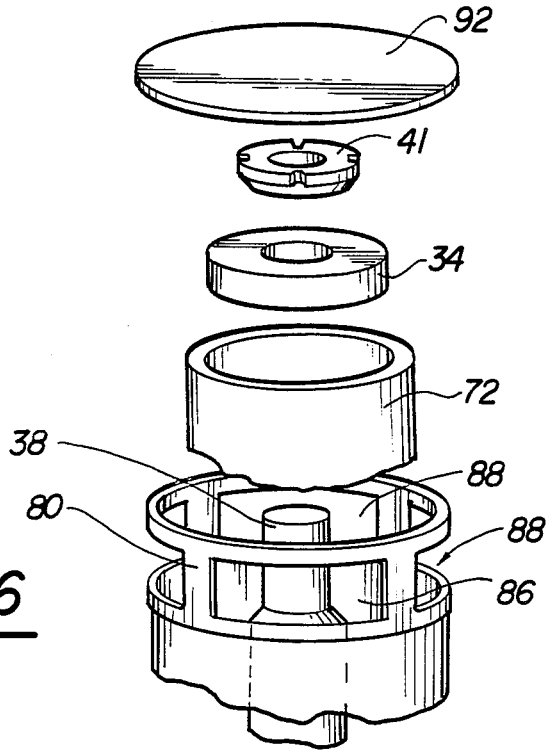
FIG. 6 is an exploded view of the structures shown in FIG. 5.

The herein invention may comprise additional structures, such as two piece sleeve 82 which, as depicted in FIG. 5, is mounted over the end of the hollow tube 70 adjacent air outlet 90 disposed in motor casing 31. Sleeve 82 provides a means of adjusting the length of hollow pipe 74 to accommodate different length drive belts or different pulley sizes used in the operation of a turbo-compressor 37.

While the herein invention has been described with respect to certain embodiments and exemplifications thereof, it is not intended to be so limited but solely by the claims appended hereto.

I claim:

1. A turbo-compressor air supply system for supplying air at relatively low pressure and high volume to a paint spray system or the like, said air supply system comprising:

a drive motor and a casing;

a turbo-compressor including:

a housing;

a drive shaft having first and second ends, said first and second ends projecting from said housing;

a bearing housing projecting from the compressor housing and disposed concentrically around and spaced from the first projecting end of the drive shaft; and a bearing disposed concentrically around the projecting first end of the drive shaft and between the projecting first end and the bearing housing;

means for supplying a stream of cooling air at a positive pressure to the bearing housing;

drive train means coupling the drive motor with the projecting second end of the compressor drive shaft to enable said motor to drive said turbo-compressor; and means placing the bearing housing in fluid communication with the means for supplying a stream of cooling air, wherein at least a portion of a stream of air supplied by the cooling air supply means, while the turbo-compressor air supply system is in operation, is diverted through the means of fluid communication and around and into the bearing housing to cool the bearing.

2. The invention of claim 1 further comprising an air space formed between an air intake and at least part of the bearing housing.

3. The invention of claim 1 further comprising air outlet means disposed around the bearing housing.

4. A turbo-compressor air supply system for supplying air at relatively low pressure and high volume to a paint spray system or the like, said air supply system comprising:

a drive motor, and a casing;

a turbo-compressor including:

a housing;

a drive shaft projecting from said casing, said shaft having first and second ends, said first and second ends projecting from said housing;

a bearing housing projecting from the compressor housing and disposed concentrically around and spaced from the first projecting end of the drive shaft; and a bearing disposed concentrically around the projecting first end of the drive shaft and between the projecting first end and the bearing housing;

means for drawing ambient air taken into the motor casing while the turbo-compressor air supply system is in operation;

drive train means coupling the drive motor with the projecting second end of the compressor drive shaft to enable said motor to drive said turbo-compressor, the drive train means coupling the drive motor drive shaft with the projecting second end of the compressor drive motor; and means placing the bearing housing in fluid communication with the ambient air drawing means, wherein at least a portion of a stream of the ambient air drawing means is diverted through the means of fluid communication and into the bearing housing to cool the bearing.

5. The invention of claim 4 further comprising an air outlet disposed in the motor casing and an air inlet disposed in the bearing housing, wherein the air outlet and the air inlet are placed in fluid communication by means of the fluid communication means.

6. The invention of claim 5 wherein the fluid communication means comprises a hollow tube.

7. The invention of claim 6 wherein the fluid communication means further comprises means of adjusting the length thereof.

8. The invention of claim 7 wherein the means of adjusting comprises an adjustable slide disposed over an end of the hollow tube, said adjustable slide including means of connection to one of said air inlet and said air outlet.

9. A turbo-compressor air supply system for supplying air at relatively low pressure and high volume to a paint spray system or the like, said air supply system comprising:

a drive motor including:

a casing;

a drive shaft projecting from said casing;

air intake means in fluid communication with said casing; and an air outlet disposed in the motor housing;

a turbo-compressor including:

a housing;

a drive shaft having first and second ends, said first and second ends projecting from said housing;

a bearing housing projecting from the compressor housing and disposed concentrically around and spaced from the first projecting end of the drive shaft;

an air inlet disposed in the bearing housing;

air outlet means disposed in the bearing housing; and a bearing disposed concentrically around the projecting first end of the drive shaft and between the projecting first end and the bearing housing and defining an air space therebetween;

drive train means coupling the drive motor drive shaft with the projecting second end of the compressor drive shaft to enable said motor to drive said turbo-compressor; and a hollow tube connecting the air outlet in the motor casing and the air inlet in the bearing housing to place the bearing housing in fluid communication with the drive motor casing, thereby placing said bearing housing in fluid communication with said air intake means, wherein a portion of a stream of air taken into the motor casing through the air intake means while the turbocompressor air supply system in operation is diverted through the hollow tube and into the bearing housing to cool the bearing.

10. The invention of claim 9 wherein the fluid communication means further comprises means of adjusting the length thereof.

11. The invention of claim 10 wherein the means of adjusting comprises an adjustable slide disposed over an end of the hollow tube, said adjustable slide including means of connection to one of said air inlet and said air outlet.

* * * * *